US009986824B2

(12) United States Patent
Vallo et al.

(10) Patent No.: US 9,986,824 B2
(45) Date of Patent: Jun. 5, 2018

(54) MOBILE STORAGE SYSTEMS

(71) Applicants: Matthew John Vallo, Dayton, OH (US); Lawrence Joseph Janning, Xenia, OH (US)

(72) Inventors: Matthew John Vallo, Dayton, OH (US); Lawrence Joseph Janning, Xenia, OH (US)

( * ) Notice: Subject to any disclaimer, the term of this patent is extended or adjusted under 35 U.S.C. 154(b) by 31 days.

(21) Appl. No.: 15/418,341

(22) Filed: Jan. 27, 2017

(65) Prior Publication Data

US 2017/0208935 A1 Jul. 27, 2017

Related U.S. Application Data

(60) Provisional application No. 62/287,561, filed on Jan. 27, 2016.

(51) Int. Cl.

| | |
|---|---|
| ***B65D 25/54*** | (2006.01) |
| ***A47B 43/00*** | (2006.01) |
| ***A45C 5/03*** | (2006.01) |
| ***A45C 7/00*** | (2006.01) |
| ***A45C 9/00*** | (2006.01) |
| ***A47B 31/04*** | (2006.01) |
| ***A47B 88/427*** | (2017.01) |
| ***A47B 61/06*** | (2006.01) |
| ***A47B 88/487*** | (2017.01) |
| ***A47B 95/02*** | (2006.01) |
| *A47B 31/00* | (2006.01) |

(52) U.S. Cl.

CPC ..... *A47B 43/00* (2013.01); *A45C 5/03* (2013.01); *A45C 7/0036* (2013.01); *A45C 9/00* (2013.01); *A47B 31/04* (2013.01); *A47B 61/06* (2013.01); *A47B 88/427* (2017.01); *A47B 88/487* (2017.01); *A47B 95/02* (2013.01); *A47B 2031/003* (2013.01); *A47B 2088/4274* (2017.01); *A47B 2095/026* (2013.01)

(58) Field of Classification Search

CPC ..... A45C 7/0045; A45C 5/14; A45C 7/0086; A45C 5/00; A45C 3/00

USPC ..... 190/100, 108, 107, 110, 18 A; 211/135, 211/149, 189, 201; 312/258, 259

See application file for complete search history.

(56) References Cited

U.S. PATENT DOCUMENTS

| | | | |
|---|---|---|---|
| 2,714,433 | A | 8/1955 | Wilson |
| 2,891,639 | A | 6/1959 | Betts |
| 3,891,230 | A | 6/1975 | Mayer |

(Continued)

*Primary Examiner* — Fenn C Mathew
*Assistant Examiner* — Cynthia Collado
(74) *Attorney, Agent, or Firm* — Porter, Wright, Morris & Arthur, LLP

(57) ABSTRACT

A mobile storage system includes a cabinet convertible between an open configuration for storing items and a folded configuration for transportation of the cabinet. The cabinet includes rear, left, right, top, and bottom walls that cooperate to form an Interior storage space having a front opening. The cabinet further includes a pair of wheels and a handle so that the cabinet can be moved as a cart. One or more drawers can be removably connected to and supported by drawer slides within the cabinet so that the drawers are movable into and out of the Interior storage space through the front opening. The drawers can be configured to be used as drawers for long term storage when located within the cabinet and as suitcases for travelling storage when removed from the cabinet.

20 Claims, 10 Drawing Sheets

(56) References Cited

U.S. PATENT DOCUMENTS

| | | | | |
|---|---|---|---|---|
| 3,974,898 | A | 8/1976 | Tullis et al. | |
| 4,118,048 | A | 10/1978 | Spranger et al. | |
| 4,813,521 | A | 5/1989 | Goldstone | |
| 5,906,381 | A * | 5/1999 | Hovatter | B25H 3/028 280/47.18 |
| 6,520,514 | B2 * | 2/2003 | Clegg | A45C 5/14 280/47.26 |
| 6,572,272 | B2 * | 6/2003 | Ngo | G02B 6/3825 385/53 |
| 7,779,976 | B2 | 8/2010 | Mangano | |
| 8,011,484 | B2 | 9/2011 | McIntyre | |
| 8,561,769 | B2 | 10/2013 | Andochick | |
| 2005/0077136 | A1 | 4/2005 | Brannin | |
| 2005/0145458 | A1 | 7/2005 | Cohen | |
| 2006/0096821 | A1 | 5/2006 | McKaba | |
| 2012/0223209 | A1 * | 9/2012 | Baylor | A47B 19/08 248/460 |

* cited by examiner

MOBILE STORAGE SYSTEMS

CROSS-REFERENCE TO RELATED APPLICATIONS

This application claims the priority benefit of U.S. Provisional Patent Application No. 62/287,561 filed on Jan. 27, 2016, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to storage systems such as, for example, furniture and the like and, more particularly, to mobile storage systems that can be used by transient individuals to transport and store clothing, personal items, and/or the like both at destinations and during transport.

BACKGROUND OF THE INVENTION

Transient individuals such as, for example, college students, traveling professionals, children in shared parenting relationships, and the like, must move, ship/transport, and/or relocate their furniture, clothing, and/or personal belongings on a regular basis. This can be difficult, inconvenient, time consuming, and/or expensive when using traditional furniture or other known storage systems.

Traditional furniture such as, for example, a dresser or chest of drawers, is often large, heavy, and cumbersome to move. Additionally, clothing and/or personal items stored in the furniture must be removed from the furniture and packed in boxes, luggage and the like for transport, transported to the new location, and then unpacked and placed back into the furniture.

Accordingly, there is a need in the art for improved furniture and/or mobile storage systems and methods that enable a person to move, ship/transport and/or re-locate with minimal effort and inconvenience.

SUMMARY OF THE INVENTION

Disclosed are mobile storage systems and methods that overcome at least one of the disadvantages of the prior art described above. For example, disclosed is a mobile storage system comprising, in combination, a cabinet including a rear wall, opposed left and right side walls hingedly connected to the rear wall, a top wall hingedly connected to the rear wall, and a bottom wall hingedly connected to the rear wall. The cabinet is configured to be converted between an open configuration for use and a folded configuration for transportation. In the open configuration, the left and right side walls are parallel and each perpendicularly extend from the rear wall in a forward direction, the top wall perpendicularly extends from the rear wall in the forward direction and horizontally extends between the left and right side walls, the bottom wall perpendicularly extends from the rear wall in the forward direction and horizontally extends between the left and right side walls, and the top wall is parallel with and spaced-apart from the bottom wall so that the rear wall, the left and right side walls, the top wall, and the bottom wall cooperate to form an interior space having a front opening opposite the rear wall. In the folded configuration, the left and right side walls are each parallel with and in front of the rear wall, the top wall is parallel with and in front of the rear wall, and the bottom wall is parallel with and in front of the rear wall. The cabinet further includes a pair of laterally spaced-apart wheels located at the bottom of the rear wall.

Also disclosed is a mobile storage system comprising, in combination, a cabinet including a rear wall, opposed left and right side walls connected to the rear wall, a top wall connected to the rear wall, a bottom wall connected to the rear wall, and at least one pair of drawer slides secured to the left and right side walls respectively. The rear wall, the left and right side walls, the top wall, and the bottom wall cooperate to form an interior space having a front opening opposite the rear wall. The mobile storage system further includes at least one drawer removably connected to and supported by the drawer slides so that the drawer is movable into and out of the interior space through the front opening. The at least one drawer is configured as a suitcase.

Also disclosed is a mobile storage system comprising, in combination, a cabinet including a rear wall, opposed left and right side walls connected to the rear wall, a top wall connected to the rear wall, and a bottom wall connected to the rear wall. The cabinet is configured to be converted between an open configuration for use and a folded configuration for transportation. In the open configuration, the left and right side walls are parallel and each perpendicularly extend from the rear wall in a forward direction, the top wall perpendicularly extends from the rear wall in the forward direction and horizontally extends between the left and right side walls, the bottom wall perpendicularly extends from the rear wall in the forward direction and horizontally extends between the left and right side walls, and the top wall is parallel with and spaced-apart from the bottom wall so that the rear wall, the left and right side walls, the top wall, and the bottom wall cooperate to form an interior space having a front opening opposite the rear wall. In the folded configuration, the left and right side walls are each parallel with and in front of the rear wall, the top wall is parallel with and in front of the rear wall, and the bottom wall is parallel with and in front of the rear wall. The cabinet further includes a pair of laterally spaced-apart wheels located at the bottom of the rear wall and at least one pair of drawer slides secured to the left and right side walls respectively. The mobile storage system further comprises at least one drawer removably connected to and supported by the at least one pair of drawer slides so that the at least one drawer is movable into and out of the interior space through the front opening. The at least one drawer is configured as a suitcase.

From the foregoing disclosure and the following more detailed description of various preferred embodiments it will be apparent to those skilled in the art that the present invention provides a significant advance in the technology and art of mobile storage systems. Particularly significant in this regard is the potential the invention affords for mobile storage systems that can be moved, shipped/transported and/or re-located with minimal effort and inconvenience.

Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
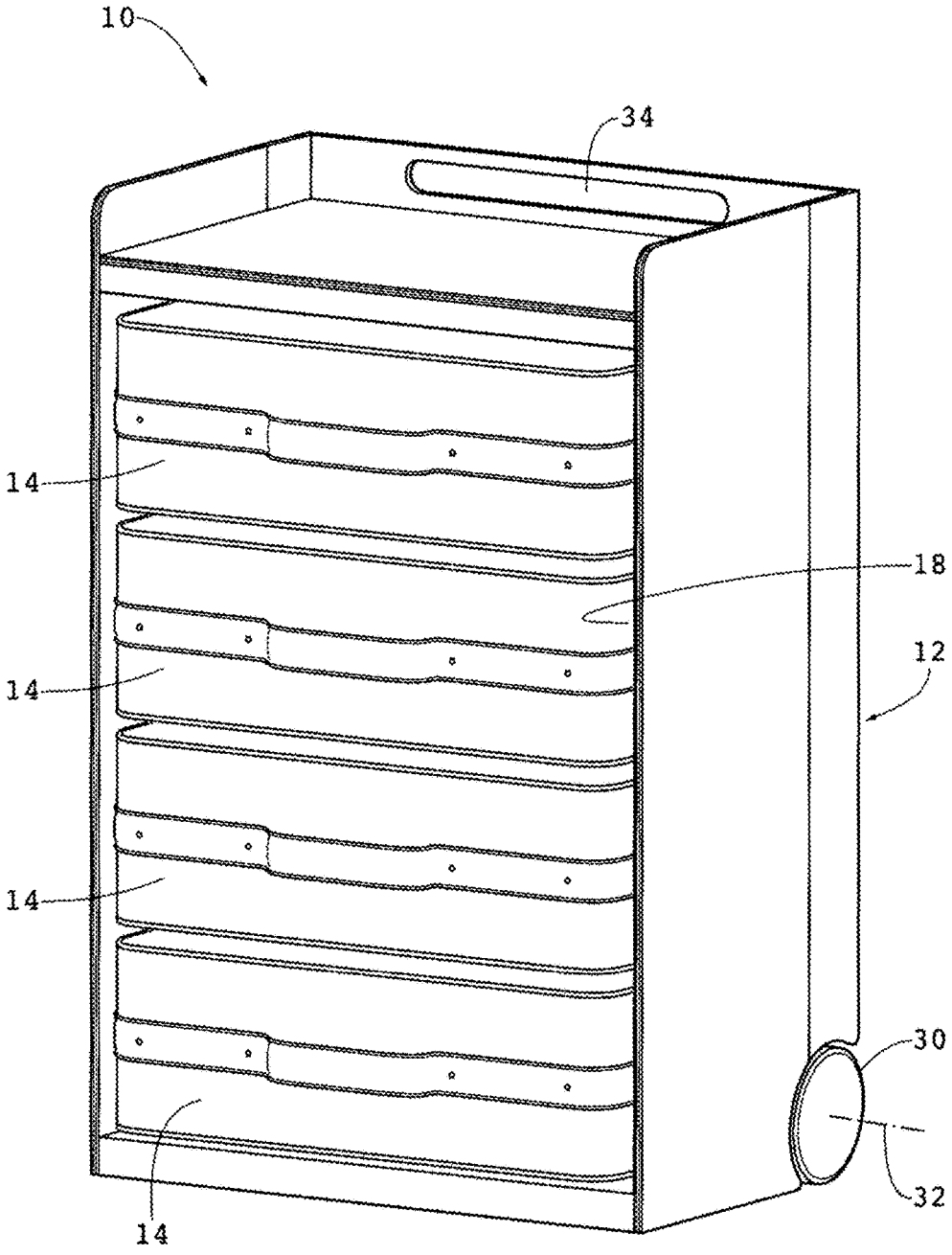
FIG. 1 is a perspective view of a mobile storage system according to a first embodiment of the present invention, wherein a cabinet of the mobile storage system is in an open or extended configuration.
Figure 2:
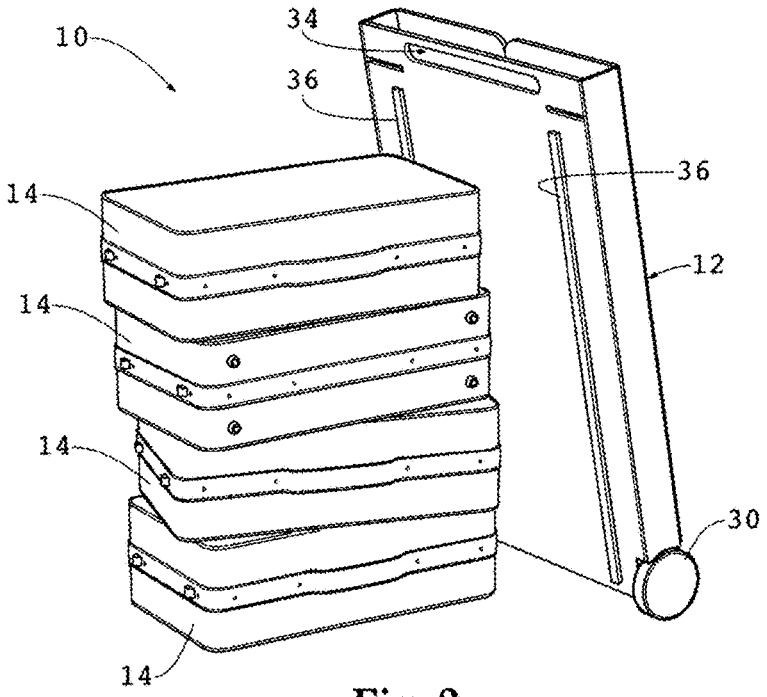
FIG. 2 is a perspective view of the mobile storage system of FIG. 1, but wherein the drawers in the form of suitcases are removed from the cabinet and the cabinet is in a closed or folded configuration.

It should be understood that the appended drawings are not necessarily to scale, presenting a somewhat simplified representation of various preferred features illustrative of the basic principles of the invention. The specific design features of the mobile storage systems as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the mobile storage systems illustrated in the drawings. In general, up or upward refers to an upward direction generally within the plane of the paper in FIG. 1 and down or downward refers to a downward direction generally within the plane of the paper in FIG. 1. Also in general, forward or front refers to a direction extending out of the plane of the paper in FIG. 1 and back or rear refers to a direction extending into the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the furniture and/or mobile storage systems and methods disclosed herein. The following detailed discussion of various alternative and preferred embodiments will illustrate the general principles of the invention with regard to the specific application of a mobile storage system in the form of a dresser or chest of drawers. Other embodiments suitable for other applications such as, for example, furniture in the form of night stands, wardrobes, shelving units, storage cabinets, and the like will be apparent to those skilled in the art given the benefit of this disclosure.

FIGS. 1 to 7 illustrate a mobile storage system 10 according to a first embodiment of the present invention. The illustrated mobile storage system 10 comprises a cabinet 12 configured to be selectively converted between an open or extended configuration for use at a destination and a folded retracted configuration for transport to the destination, and at least one drawer 14 removably connected to the cabinet 12 and movable into and out of an interior space 16 of the cabinet 12 through a front opening 18 of the cabinet 12. The illustrated cabinet 12 is configured as a dresser or chest of drawers having four of the drawers 14 vertically positioned one above the other but any other suitable configuration and/or quantity of the drawers 14 can alternatively be utilized. The illustrated drawers 14 are each configured to selectively function as a suitcase when removed from the cabinet 12 but any other suitable configuration or type of the drawers can alternatively be utilized. The illustrated drawers 14 function as a typical drawer in a dresser for long term storage of personal items when the drawer 14 is in the cabinet 12 and function as a suitcase for short term storage of personal items while travelling to a destination when the drawer 14 is removed from the cabinet 12. The term "luggage is used herein and in the claims to mean bags, cases, and containers which hold a traveler's articles such as clothing, toiletries, and other small personal items during transit. The term "suitcase" is used herein and in the claims to mean a portable form of luggage with a handle so that the luggage can be hand carried by the traveler, and can be a wheeled suitcase or a non-wheeled suitcase, a soft sided suitcase or a hard sided suitcase, and an expandable suitcase or a non-expandable suitcase. The term "expandable suitcase" is used herein and in the claims to mean a suitcase having an interior packing space that can be selectively expanded and reduced, typically by unzipping and zipping a zipper or zippers.

As best shown in FIGS. 8 to 13, the illustrated cabinet 12 includes a rear wall 20, opposed left and right side walls 22, 24 extending forwardly from the rear wall 20 and connected to the rear wall 20, a top wall 26 extending forwardly from the rear wall 20 and connected to the rear wall 20, and a bottom wall 28 extending forwardly from the rear wall 20 and connected to the rear wall 20. The illustrated main wall 20 is generally U-shaped in the vertical direction (that is, in horizontal planes) having a laterally-extending main wall 20A and forwardly and perpendicularly extending side portions 20B at the lateral edges of the main portion 20A. In the open or extended configuration, the illustrated left and right side walls 22, 24 are parallel to one another and substantially perpendicular to the main portion 20A of the rear wall 20 and forwardly extend form front edges of the side portions 20B of the rear wall 20. The illustrated left and right side walls 22, 24 are each vertically extending to provide opposed inner and outer substantially planar faces which face in the lateral direction. The illustrated top and bottom walls 26, 28 are each substantially perpendicular to the main portion 20A of the rear wall 20 and forwardly extend from the main portion 20A of the rear wall 20 between the left and right side walls 26, 28. The illustrated top wall 26 is parallel with and vertically spaced-apart from the bottom wall 28. The illustrated top wall 2 is spaced slightly below a top edge of the main portion 20A of the rear wall 20 and the illustrated bottom wall 28 extends from a bottom edge of the main portion 20A of the rear wall 20. The illustrated top and bottom walls 26, 28 are each horizontally extending to provide opposed inner and outer faces which face in the vertical direction. Each of the illustrated walls 20, 22, 24, 26, 28 is generally rectangular shaped so that the interior space 16 is generally rectangular shaped with its height greater than its width, and its width greater than its depth. Configured in this manner, the inner faces of the left-side wall 22, the right-side wall 24, the top wall 26, and the bottom wall 28 form the illustrated substantially rectangular-shaped interior space 16, and the front edges of the left-side wall 22, the right-side wall 24, the top wall 26, and the bottom wall 28 form the substantially rectangular-shaped front opening 18. It is noted that the cabinet 12 can alternatively have any other suitable configuration.

The illustrated rear wall, left and right side walls, top wall, and bottom wall 20, 22, 24. 26, 28 each comprise wood. It is noted, however, that the walls 20, 22, 24. 26, 28 of the cabinet 12 can alternatively comprise any other suitable material or materials such as, for example, wood composite, plastic and the like.

The illustrated cabinet 12 also includes a pair of laterally spaced-apart wheels 30 located near the bottom of the rear wall 20 so the cabinet 12 can be supported by the wheels 30 when the cabinet 12 is rearwardly tipped about the laterally-extending rotational axis 32 of the wheels 30. The wheels 30 rotate about the laterally-extending rotational axis 32 so that the cabinet 12 can be moved in forward and rearward directions by rolling the wheels 30. The illustrated cabinet 12 is configured so that the cabinet 12 can be supported and transported on the wheels 30 in both the open or extended configuration and the closed or folded or configuration when the rear wall 20 is tilted back in the rearward direction about the rotational axis 32 of the wheels 30 near the bottom of the rear wall 20. The illustrated rear and side walls 20, 22, 24 form recesses 33 for the wheels 30 so that the wheels 30 are recessed within the cabinet 12. The illustrated rear wall 20 is also provided with a handle 34 located near the top of the rear wall 20. The illustrated handle 34 is formed by a laterally extending opening through the rear wall 20 near the top edge of the rear wall 20. It is noted that the handle 34 can alternatively have any other suitable configuration. The rear side of the illustrated rear wall 20 is provided with a pair of vertically extending and laterally spaced-apart rub strips 36 for protection of the rear wall 20 when the cabinet 12 is being moved as a cart. The rub strips 36 can comprise any suitable material such as a rubber, plastic or the like. It is noted that the rub strips 36 can alternatively have any other suitable configuration. Configured in this manner, the cabinet 12 can be moved like a two-wheeled hand cart in both the open or extended and closed or folded configurations.

The illustrated cabinet 12 also includes four pairs of drawer slides 38 wherein each of the four drawers 14 can be removably secured to an associated pair of the drawer slides 38. Each pair of horizontally-extending drawer slides 38 are secured to the opposed inner sides of the left and right side walls 22, 24 respectively in the forward/rearward direction for supporting the associated one of the drawers 14. The drawers 14 are removably connected to and supported on the drawer slides 38 so that the drawers 14 are each easily movable into and out of the interior space 16 of the cabinet 12 in the rearward/forward direction through the front opening 18. As best seen in FIGS. 4 to 7, the illustrated drawer slides 38 each include an elongated first or stationary member 40 that is rigidly secured to the associated cabinet side wall 22, 24 and an elongate second or sliding member 42 that is supported by the first member 40 and movable relative to the first member 40 so that the second member 42 can be selectively extended and retracted relative to the first member 40 in the forward/rearward direction. Bearing members 44 are provided between the first and second member 40, 42 to provide easy sliding and/or rolling movement of the second member 42 relative to the first member 40. The bearing members 44 can be wheels, sliders, and the like. The illustrated first members 40 are rigidly secured to the cabinet to substantially prevent movement therebetween with wood screws 45 but can alternatively be secured to the cabinet 12 in any other suitable manner. The illustrated second members 42 are configured to cooperate with the drawers 14 for removable connection of the drawers 14 to the second members 42 so that the drawers 14 and second members 42 are movable together into and out of the interior space 16 of the cabinet 12 through the front opening 18 by moving the second members 42 with the drawer 14 connected thereto, relative to the first members 49. The drawers 14 are removably connected to the second members 42 so that they can be selectively removed from the second members 42 to entirely remove the drawers 14 from the cabinet 12. The illustrated drawers 14 can be selectively removed from the drawer slides 38 simply by lifting the drawers 14 up off of the drawer slides 38 as described in more detail hereinbelow.

Figure 15:
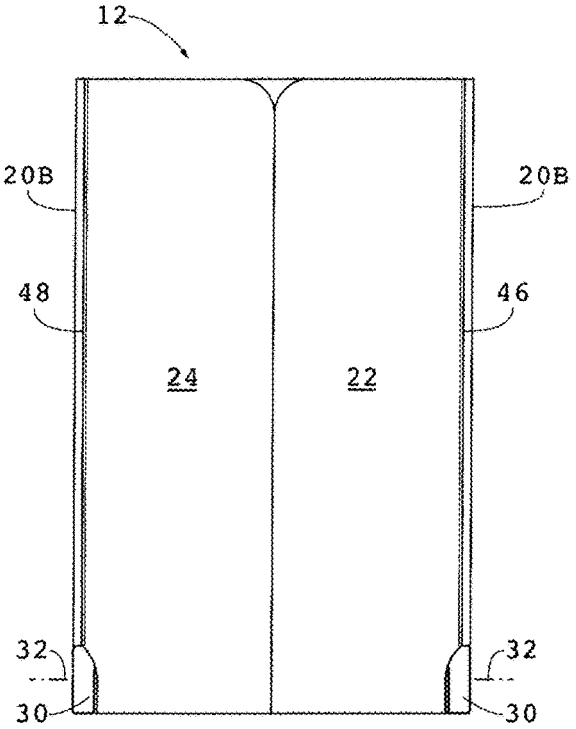
FIG. 15 is a left-side elevational view of the cabinet of FIG. 14.
Figure 14:
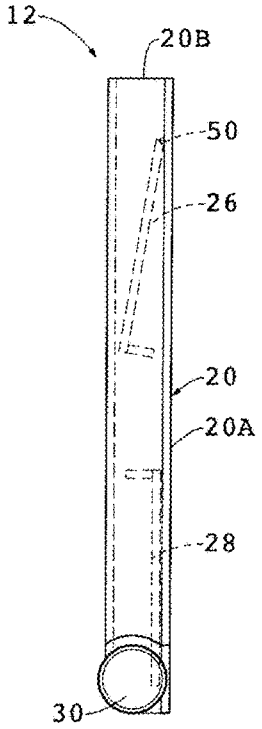
FIG. 14 is a front elevational view of the cabinet of the mobile storage system of FIGS. 1 to 6 in the closed or folded configuration.
Figure 16:
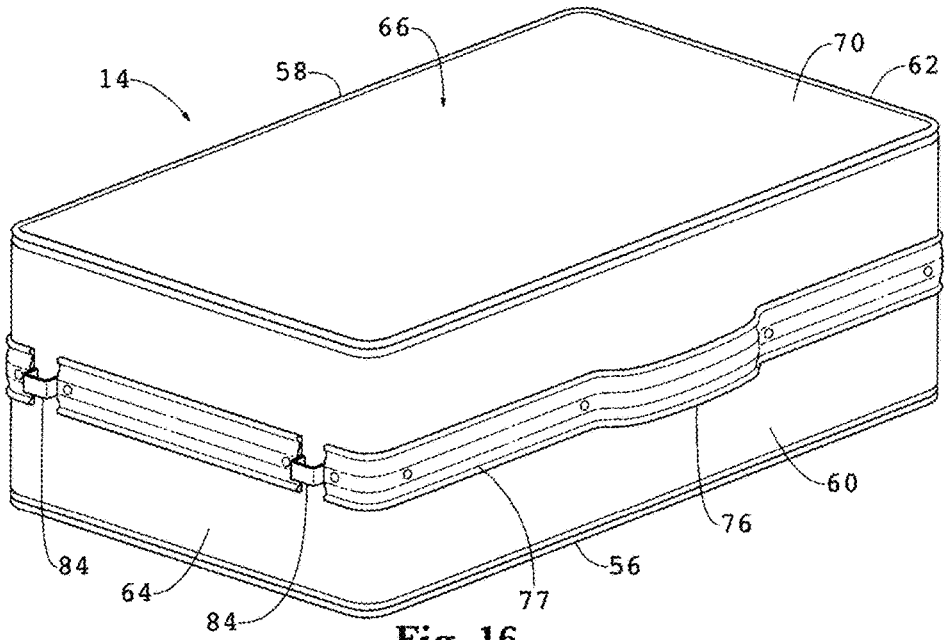
FIG. 16 is a perspective view of the top drawer/suitcase of the mobile storage system of FIGS. 1 to 6 after it has been fully removed from the cabinet and wherein a top cover has been closed.
Figure 17:
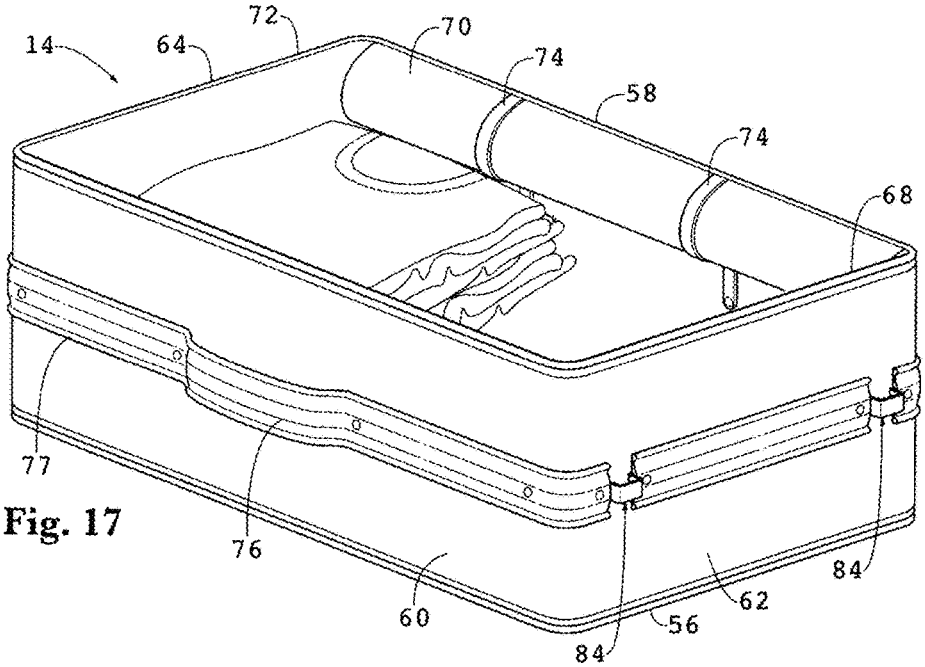
FIG. 17 is a perspective view of the top drawer/suitcase of the mobile storage system of FIGS. 1 to 6 after it has been fully removed from the cabinet and wherein the top cover is open to enable access to contents of the drawer/suitcase through the top of the drawer/suitcase.
Figure 18:
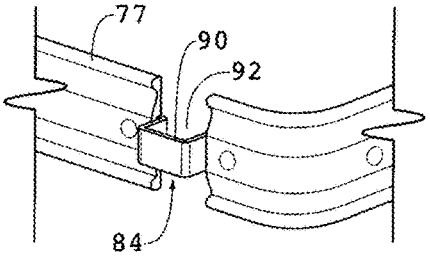
FIG. 18 is an enlarged fragmented view of a portion of the drawer/suitcase of FIG. 17 at attachment for removably attaching the drawer/suitcase to the drawer slide.
Figure 19:
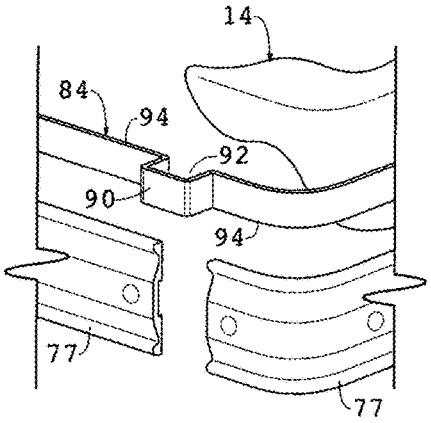
FIG. 19 is an exploded view similar to FIG. 18.

The illustrated cabinet 12 is configured to be selectively converted between the open or extended configuration for use at destinations (best shown in FIGS. 8 to 13) and the folded or retracted configuration for transport to a destination (best shown in FIGS. 14 and 15). The illustrated left and right side walls 22, 24 are hingedly connected to the rear wall 20 with vertically-extending left and right hinges 46, 48 forming vertically-extending pivot axes, the illustrated top wall 26 is hingedly connected to the rear wall 20 with a horizontally-extending top hinge 50 forming a horizontally-extending pivot axis, and the illustrated bottom wall 28 is hingedly connected to the rear wall 20 with a horizontally-extending bottom hinge 52 forming a horizontally-extending pivot axis for easy conversion of the cabinet 12 between the open or extended configuration and the closed or folded configuration. It is noted that the walls 20, 22, 24, 26, 28 can alternatively be connected in any other suitable manner. The left hinge 46 is configured so that the left side wall 22 can be selectively pivoted inwardly and rearwardly about its rear edge from its forwardly extending position perpendicular to the rear wall 20 to a position substantially parallel to the rear wall 20 and back. The right hinge 48 is configured so that the right side wall 24 can be selectively pivoted inwardly and rearwardly about its rear edge from its forwardly extending position perpendicular to the rear wall 20 to a position substantially parallel to the rear wall 20 and back. The top hinge 50 is configured so that the top wall 26 can be selectively pivoted downwardly and rearwardly about its rear edge from its forwardly extending position perpendicular to the rear wall 20 to a position substantially parallel to the rear wall 20 and back. The bottom hinge 52 is configured so that the bottom wall 28 can be selectively pivoted upwardly and rearwardly about its rear edge from its forwardly extending position perpendicular to the rear wall 20 to a position substantially parallel to the rear wall 20 and back. The hinges 46, 48, 50, 52 can be of any suitable type. Locks, latches, stops, and the like can be provided to retain the pivoting walls, 22, 24, 26, 28 in their desired positions. For example, stops 54 can be provided on the inner sides of the left and right side walls 22, 24 to support and retain the top and bottom walls 26, 28 when in the open or extended configuration. Constructed in this manner, the illustrated cabinet 12 can be about 48 inches tall, about 30 inches wide, and about 20 inches deep when in the open or extended configuration and about 48 inches tall, about 30 inches wide and about 6 inches deep when in the closed or folded configuration. It is noted, however, that any other suitable dimensions can alternatively be utilized.

In the closed or folded configuration, the illustrated left and right side walls 22, 24 are each parallel with and spaced from the front face of the rear wall 20, and the top and bottom walls 26 are parallel with and in front of the rear wall 20. In this configuration, the illustrated top and bottom walls 26, 28 are each located between the rear wall 20 and the left and right side walls 22, 24. The illustrated top and bottom walls 26, 28 are sized so that they are generally parallel and located in the same plane one above the other. That is, the depths of the top and bottom walls 26, 28 in the forward/rearward direction (when in the open configuration) combine to be less than the height of the rear wall 20. Also, the illustrated left and right side walls 22, 24 are sized so that they are generally parallel and located in the same plane side-by-side when in the folded configuration. That is, the depths of the left and right side walls 22, 24 in the forward/rearward direction (when in the open configuration) combine to be less than the width of the rear wall 20.

To convert the cabinet 12 from the open or extended configuration to the closed or folded configuration, the top wall 26 is pivoted downward about its rear edge until it is substantially parallel with and in front of the rear wall 20. The bottom wall 28 is pivoted upward about its rear edge until it is substantially parallel with and in front of the rear wall 20. Thus, the top and bottom walls 26, 28 are generally in the same plane one above the other in front of the rear wall 20. The left and right side walls 22, 24 are then each pivoted inward about their rear edges until they are substantially parallel with and in front of both the top and bottom walls 26, 28 and the rear wall 20 located behind the top and bottom walls 26, 28. Thus, the left and right side walls 22, 24 are generally in the same plane laterally side by side. To convert the cabinet 12 back from the closed or folded configuration to the open or extended configuration, the above steps are reversed.

As best seen in FIGS. 16 to 19, the illustrated drawers 14 are configured to be used as suitcases when removed from the cabinet 12. The illustrated drawers 14 are each generally rectangular-shaped having a substantially planar bottom wall 56, a rear wall 58 perpendicular to and upwardly-extending from a rear edge of the bottom wall 56, a front wall 60 perpendicular to and upwardly-extending from a front edge of the bottom wall 56, a left side wall 62 perpendicular to and upwardly-extending from a left edge of the bottom wall 56 and extending between the rear and front walls 58, 60, a right side wall 64 perpendicular to and upwardly-extending from a right edge of the bottom wall 56 and extending between the rear and front walls 64, and a top wall 66 parallel with the bottom wall 56 and spaced above the bottom wall to extended between the top edges of the rear and front walls 58, 60 and the left and right side walls 62, 64. The walls 56, 58, 60, 62, 64, 66 cooperate to form an interior storage space 68. The illustrated top wall 66 is provided with an opening 68. A lid 70 is provided for selectively closing the opening 68 to retain items within the internal storage space 68 during transport of the suitcase and opening the opening 68 to provide access to the interior storage space 68 during use of the drawer 14 with the cabinet 12. The illustrated lid 70 is removable secured to the top wall 66 with zipper 72 but can alternatively be removably secured in any other suitable manner. The illustrated lid 70 can be configured to be entirely removed and/or only partially removed such as, for example, so that the lid can rolled up near the rear wall and secured in place with retaining straps 74 (best shown in FIG. 17). Each of the illustrated walls 56, 58, 60, 62, 64, 66 is generally rectangular shaped so that the interior storage space 68 is generally rectangular shaped having a width greater than a depth, and a depth greater a than a height. It is noted that any other suitable shape can alternatively be utilized. The illustrated front wall 60 is provided with a carrying handle 76 which can be used to pull the drawer/suitcase 14 out of the cabinet 12 when connected to and located within the cabinet 12 and can be used to carry the drawer/suitcase 14 when disconnected from and removed from the cabinet 12. The illustrated drawers/suitcases 14 are also provided with a bumper 77 encircling the drawer/suitcase 14 at the handle 76. The bumper 77 extends outwardly from the walls 58, 60, 62, 64 to provide protection to the exterior sides of the walls 58, 60, 62, 64 against scraping etc. The bumper 77 can comprise any suitable material such as for example, rubber, plastic, leather, and the like. Configured in this manner, the illustrated drawers/suitcases 14 can each have an individual interior storage space volume of about 2 cubic feet so that the total interior storage space volume is about 8 cubic feet for the four drawers/suitcases 14. It is noted that any other suitable individual and/or total interior storage space volume can alternatively be utilized.

Figure 3:
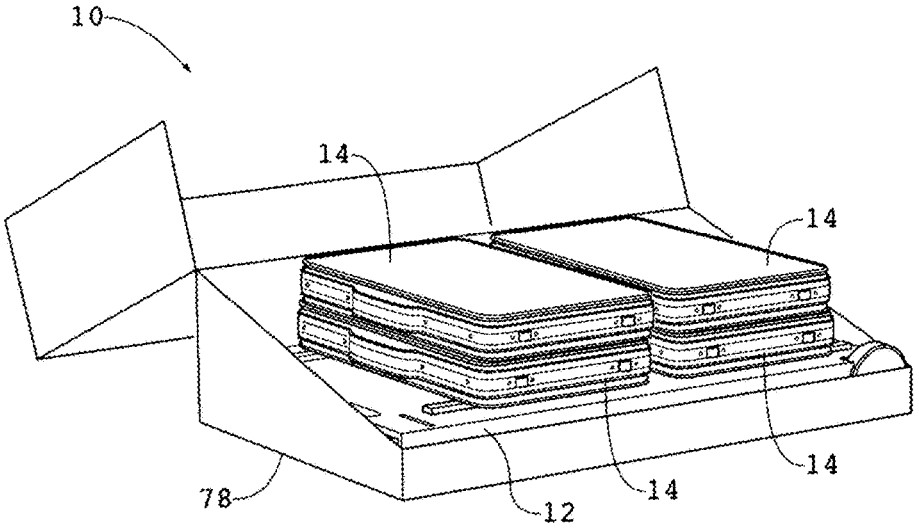
FIG. 3 is a perspective view of the mobile storage system of FIGS. 1 and 2, but wherein the cabinet is in the folded configuration, the drawers/suitcases are in a non-expanded configuration, and both the cabinet and drawers/suitcases are located in a shipping carton in preparation for shipment.
Figure 4:
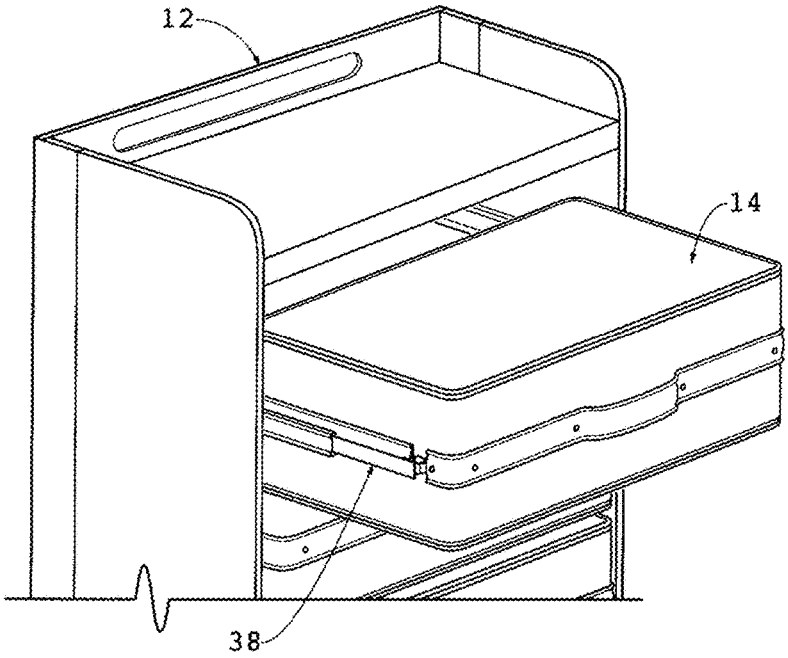
FIG. 4 is a fragmented and enlarged perspective view of the mobile storage system of FIG. 1, wherein a top drawer/suitcase is partially pulled out of the cabinet and supported by a pair of drawer slides.
Figure 5:
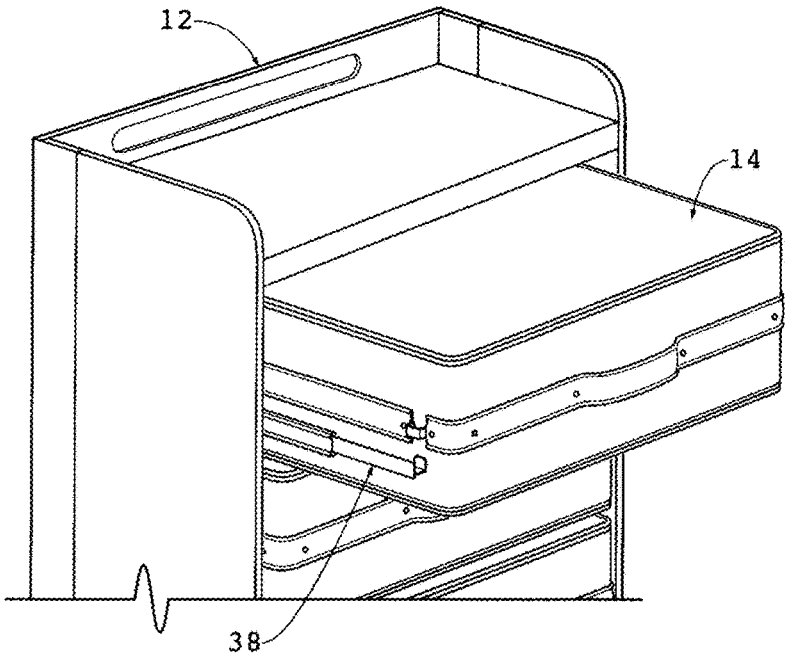
FIG. 5 is a fragmented and enlarged perspective view of the mobile storage system similar to FIG. 4, but wherein the top drawer/suitcase is partially pulled out of the cabinet and lifted up off of the pair of drawer slides.
Figure 6:
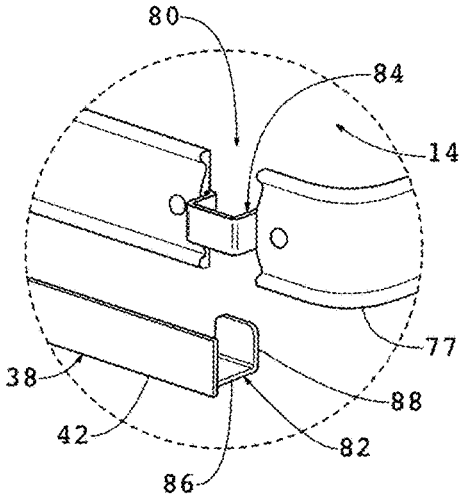
FIG. 6 is an enlarged fragmented view showing a portion of FIG. 5 at the interface of the drawer/suitcase and one of the drawer slides.
Figure 7:
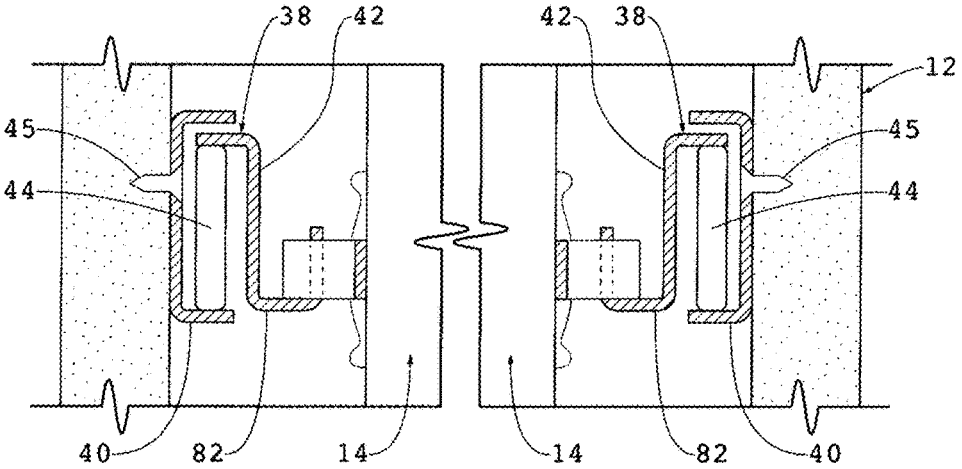
FIG. 7 is a diagrammatic view showing removable attachment at the interface between the top drawer/suitcase and the pair of drawer slides secured to the cabinet of the mobile storage system of FIGS. 1 to 6 supporting the top drawer/suitcase.
Figure 10:
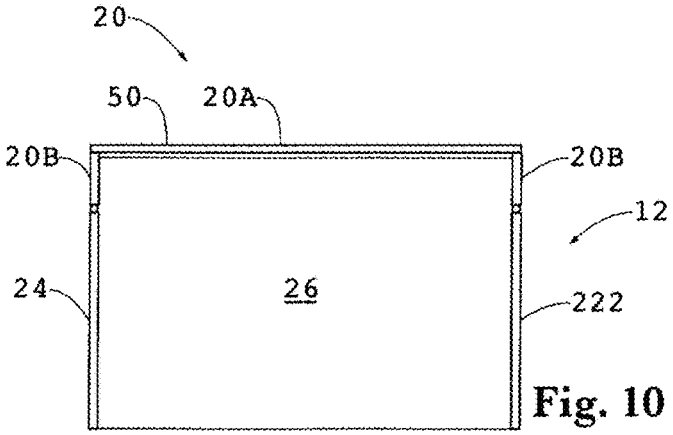
FIG. 10 is a top plan view of the cabinet of FIGS. 8 and 9.
Figure 8:
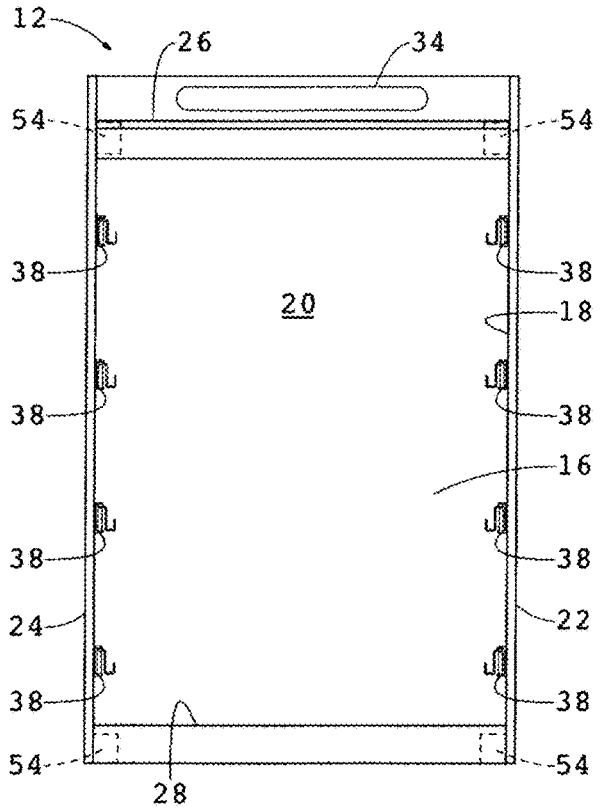
FIG. 8 is a front elevational view of the cabinet of the mobile storage system of FIGS. 1 to 6 in the open or extended configuration.
Figure 9:
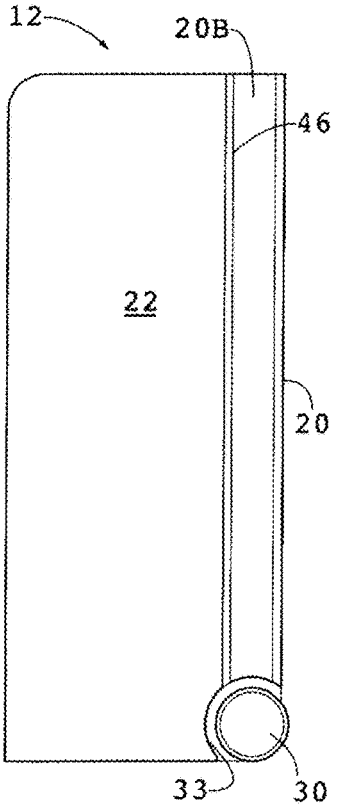
FIG. 9 is a left-side elevational view of the cabinet of FIG. 8.
Figure 11:
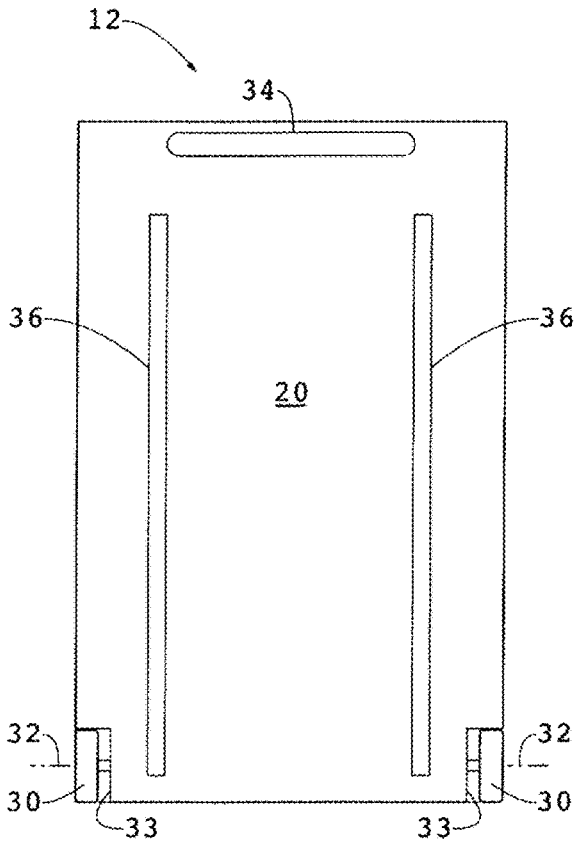
FIG. 11 is a rear elevational view of the cabinet of FIGS. 8 to 10.
Figure 12:
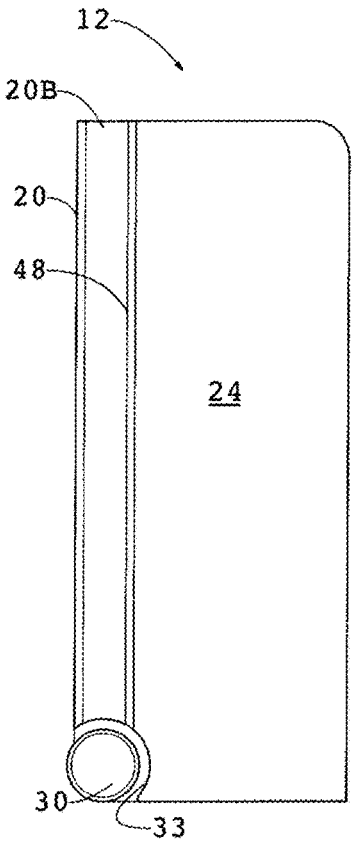
FIG. 12 is a right-side elevational view of the cabinet of FIGS. 8 to 11.
Figure 13:
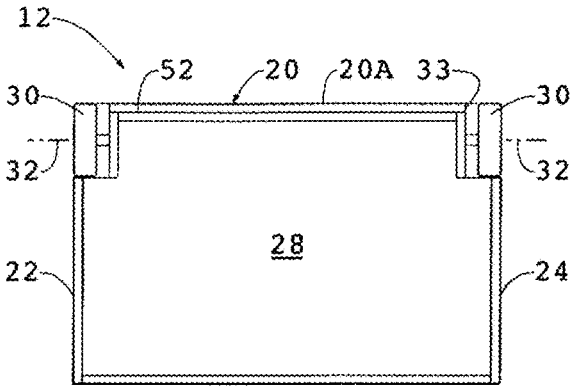
FIG. 13 is a bottom plan view of the cabinet of FIGS. 8 to 12.

The illustrated drawers/suitcases 14 are each configured to be an expandable suitcase so that its size can be reduced for shipping when not being used as a drawer or a suitcase. FIG. 3 illustrates the collapsible drawers/suitcases 14 when they have been collapsed in the vertical direction for shipment and located within a shipping container 78 with the cabinet 12 in its closed or folded configuration to reduce the size of the shipping container 78. It is noted that the drawers/suitcases 14 can alternatively have any other suitable configuration. The illustrated shipping container 78 can be about 13 inches tall, about 31 inches wide, and about 49 inches long but it is noted that the shipping container 78 can alternatively have any other suitable dimensions.

Attachments 80 are provided for removably securing the drawers 14 to the second members 42 of the drawer slides 38. The illustrated attachments 80 enable quick and easy removal of the draws 14 from the draw slides 38. It is noted that the drawers 14 are not secured to the drawer slides with threaded fasteners like conventional furniture because they cannot be quickly and easily removed if secured in that manner. The illustrated attachments 80 each include a hook or tab 82 upwardly extending from the second member 42 of the drawer slide 38 and a cooperating bracket 84 extending laterally outward from a side of the drawer/suitcase 14. The illustrated draws/suitcases 14 each utilize four of the attachments 80 but any other suitable quantity can alternatively be utilized. Each second member 42 of the illustrated drawer slides 38 includes a pair of the tabs 82 spaced-apart in the forward/rearward direction that cooperate with a pair of the spaced-apart brackets 84 secured to each lateral side of the illustrated drawer/suitcase 14. The illustrated tabs 82 each include a horizontally-extending first portion 86 that inwardly extends from the second member 42 of the drawer slide 38 and an upwardly and vertically extending second portion 88 from the inward or free end of the first portion 86. It is noted that the tabs 82 can alternatively have any other suitable configuration. The illustrated tabs 82 are formed integral with the second member 40 in a one-piece construction but can alternatively be securely attached thereto. The illustrated brackets 84 each outwardly extend from the lateral sides of the drawer/suitcase 14 and have a U-shaped central portion 90 forming a vertically extending opening 92 sized for receiving the second portion 88 of the tab 82 therethrough and flange portions 94 extending outwardly from the central portion 90. The illustrated brackets 84 are formed as a one-piece component which encircles the drawer/suitcase and is secured to the drawer/suitcase 14 with the bumper 77. The flange portions 94 are located below the bumper 77 with the central portions 90 extending through breaks in the bumper 77 with the flanges 94 extending under edges of the bumper 77. The illustrated brackets comprise metal but any other suitable material or materials can alternatively be utilized. It is also noted that the brackets 84 can alternatively have any other suitable configuration and/or can be secured to the drawer/suitcase 14 in any other suitable manner.

To removably secure the drawer/suitcase 14 to the drawer slides 38, the drawer/suitcase 14 is vertically lowered so that the central portions 90 of the brackets 84 rest directly on the first portion 86 of the tabs 82 with the second portion 88 of the tabs upwardly extending through the openings 92 of the brackets 84 so that the drawer/suitcase 14 is supported on the tabs 82, and thus supported by the drawer slides 38, and movement of the drawer/suitcase 14 relative the second members 42 of the drawer slides 38 is limited in each direction except for vertically upward. The drawers/suitcases 14 can be easily disconnected from the drawer slides 38 by lifting the drawer/suitcase 14 upward in the vertical direction until the brackets 84 are removed from the tabs 82. It is noted that any other suitable quantity of attachments can alternatively be utilized. It is also noted that any other suitable configuration for the attachments can alternatively be utilized and/or any other suitable means can be alternatively utilized for removably connecting the drawers/suitcase 14 to the drawer slides 38.

Figure 20:
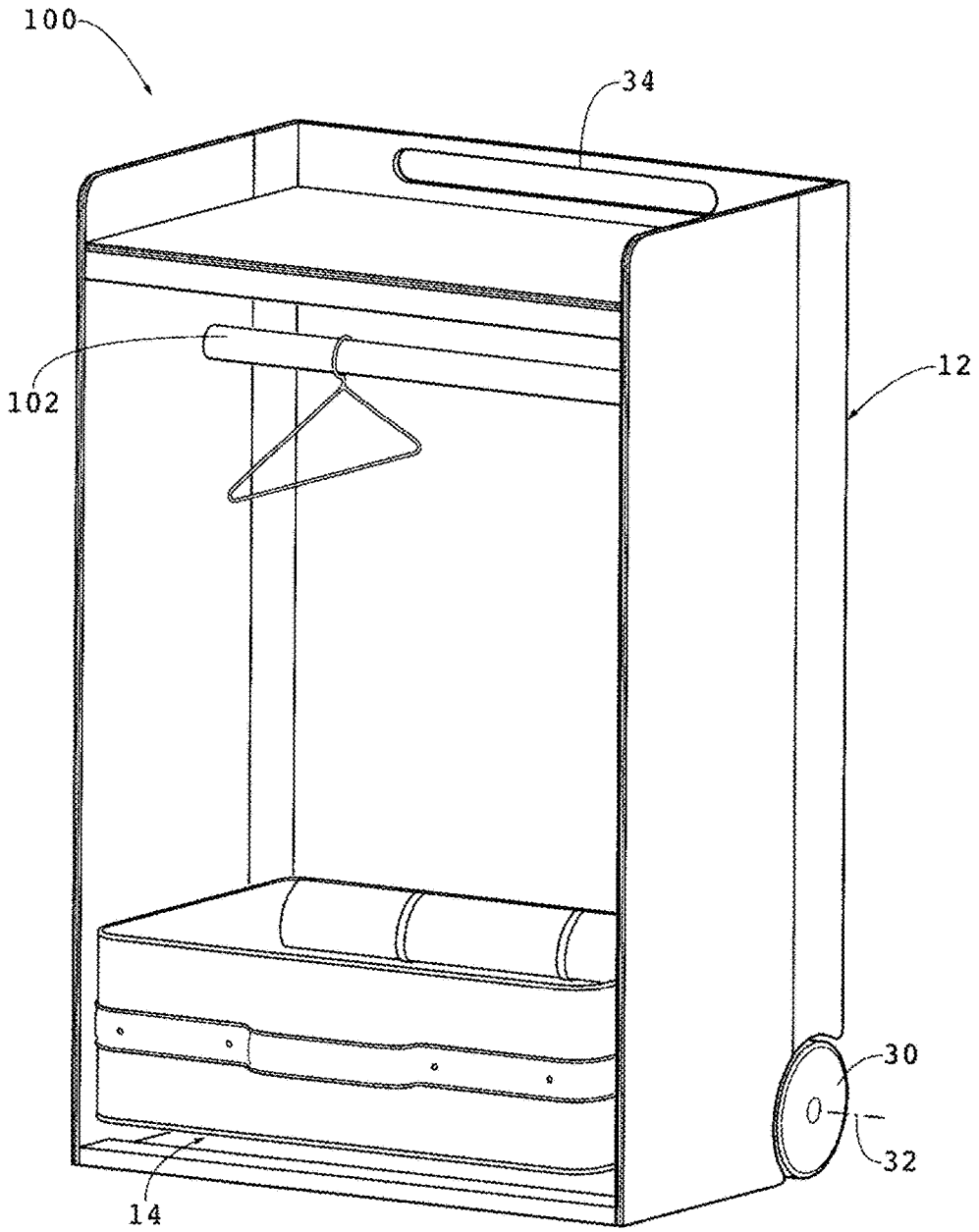
FIG. 20 is a perspective view of a mobile storage system according to a second embodiment of the present invention, wherein the cabinet of the mobile storage system is in an open or extended configuration and is configured as a wardrobe with a single drawer/suitcase.

FIG. 20 illustrates a mobile storage system 100 according to a second embodiment of the present invention. The second embodiment of the invention is substantially the same as the first embodiment of the present invention described hereinabove except that the cabinet 12 is configured as a wardrobe having a single drawer/suitcase 14. The single drawer/suitcase 16 is located near the bottom of the cabinet 12 and can be used to store footwear and the like. A removable hanging rod 102 extends between the left and right side walls 22, 24 below and near the top wall 26 that can be used to hang clothing within the cabinet 12 using hangers or the like. This second embodiment of the invention illustrates that the cabinet 12 can have other configurations and that the other quantities of drawers/suitcases 14 can be utilized.

Figure 21:
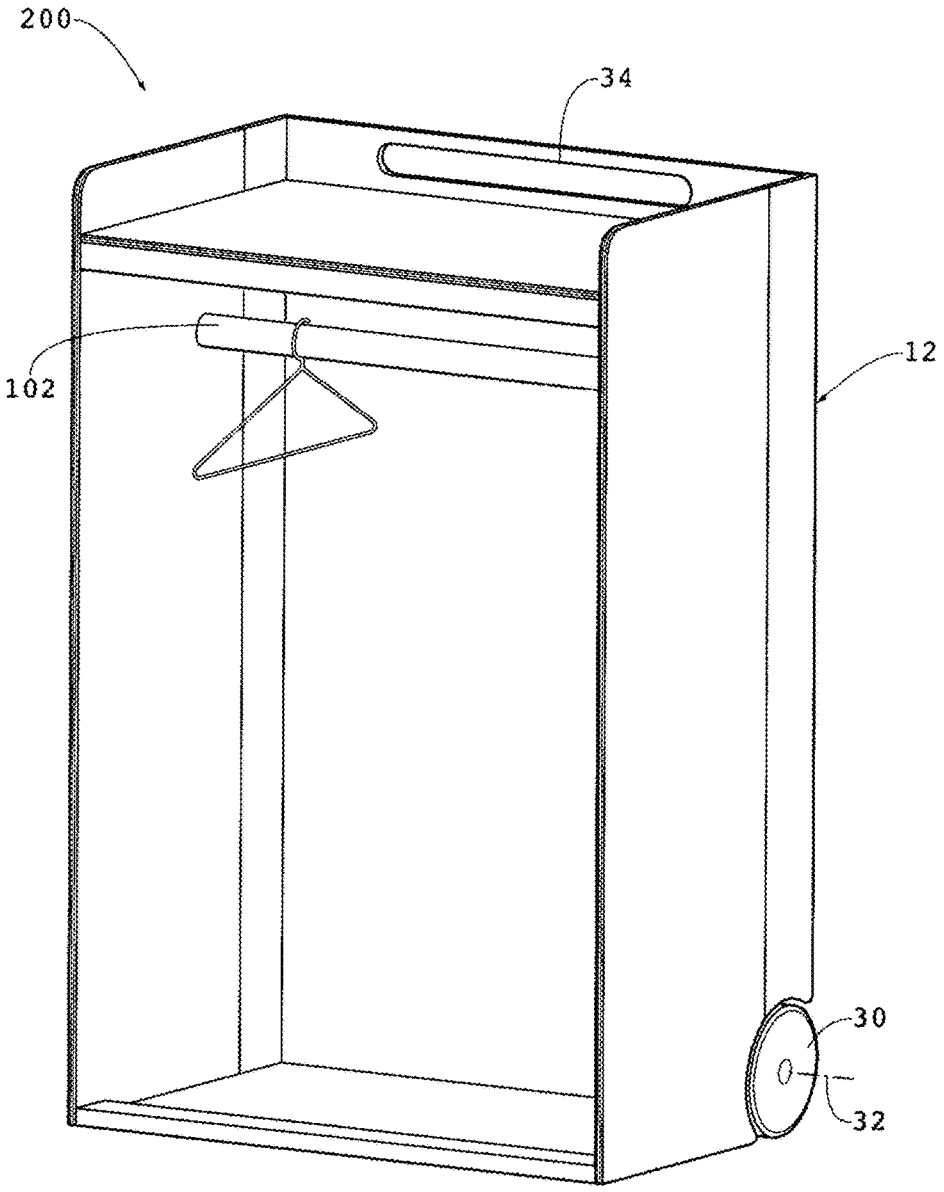
FIG. 21 is a perspective view of a mobile storage system according to a third embodiment of the present invention, wherein the cabinet of the mobile storage system is in an open or extended configuration and is configured as a wardrobe without any drawers.

FIG. 21 illustrates a mobile storage system 200 according to a third embodiment of the present invention. The third embodiment of the invention is substantially the same as the first and second embodiments of the present invention described hereinabove except that the cabinet 12 is configured as a wardrobe having no drawers/suitcases 14. A removable hanging rod 102 extends between the left and right side walls 22, 24 below and near the top wall 20 that can be used to hang clothing within the cabinet 12 using hangers or the like. This third embodiment of the invention illustrates that the cabinet 12 can have configurations without drawers/suitcases 14.

Any of the features or attributes of the above-described embodiments and variations can be used in combination with any of the other features and attributes of the above-described embodiments and variations as desired.

From the foregoing disclosure it will be apparent that the illustrated mobile storage system provides greatly improved versatility and simplified, safe and economic transport of a traditionally heavy and cumbersome design. The disclosed embodiment includes easy to-remove/install drawers that can double as suitcases for weekend travel and the like and the cabinet has wheels and a handle that allow for easy moving while either in the open configuration or the folded configuration.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A mobile storage system comprising, in combination:

a cabinet including a rear wall, opposed left and right side walls hingedly connected to the rear wall, a top wall hingedly connected to the rear wall, and a bottom wall hingedly connected to the rear wall;

wherein the cabinet is configured to be converted between an open configuration for use and a folded configuration for transportation;

wherein, in the open configuration, the left and right side walls are parallel and each perpendicularly extend from the rear wall in a forward direction, the top wall perpendicularly extends from the rear wall in the forward direction and horizontally extends between the left and right side walls, the bottom wall perpendicularly extends from the rear wall in the forward direction and horizontally extends between the left and right side walls, and the top wall is parallel with and spaced-apart from the bottom wall so that the rear wall, the left and right side walls, the top wall, and the bottom wall cooperate to form an interior space having a front opening opposite the rear wall;

wherein, in the folded configuration, the left and right side walls are each parallel with and in front of the rear wall, the top wall is parallel with and in front of the rear wall, and the bottom wall is parallel with and in front of the rear wall; and wherein the cabinet further includes a pair of laterally spaced-apart wheels located at the bottom of the rear wall;

at least one pair of drawer slides secured to the left and right side walls respectively;

wherein the drawer slides each include an elongate first member that is rigidly secured to the associated side wall in the forward/rearward direction to prevent relative movement between the first member and the associated side wall and an elongate second member that is supported by the elongate first member and longitudinally movable relative to the first member in the forward/rearward direction so that the elongate second member can be selectively extended and retracted relative to the elongate first member in the forward/rearward direction;

at least one drawer removably connected to and supported by the elongate second members of the drawer slides so that the drawer is selectively movable into and out of the interior space through the front opening with the elongate second members of the drawer slides; and wherein the at least one drawer is selectively secured and removed from the elongate second members of the drawer slides by lowering and lifting the at least one drawer in the vertical direction relative to the elongate second members of the drawer slides.

2. The mobile storage system according to claim 1, wherein, in the folded configuration, the top wall and the bottom wall are each located between the rear wall and the left and right side walls.

3. The mobile storage system according to claim 1, wherein the cabinet is configured so that the cabinet can be supported and transported on the wheels in both the open configuration and the folded configuration.

4. The mobile storage system according to claim 1, further comprising a handle located at a top of the rear wall.

5. The mobile storage system according to claim 1, wherein there is a plurality of the drawers removably connected to the cabinet and movable into and out of the interior space through the front opening.

6. The mobile storage system according to claim 1, wherein the at least one drawer is configured as a suitcase.

7. The mobile storage system according to claim 6, wherein the suitcase is an expandable suitcase.

8. The mobile storage system according to claim 1, wherein opposed lateral sides of the at least one drawer are each provided with at least one bracket configured to receive an upwardly-extending tab of the elongate second members of the pair of drawer slides when the at least one drawer is lowered onto the elongate second members of the pair of drawer slides in the vertical direction to removably secure the at least one drawer to the elongate second members of the pair of drawer slides.

9. The mobile storage system according to claim 1, further comprising attachments configured to removably secure the at least one drawer to the elongate second members of the drawer slides when the at least drawer is lowered in the vertical direction onto the elongate second members of the pair of drawer slides, and wherein the attachments each include a vertically extending tab insertable into a cooperating bracket when the at least drawer is lowered in the vertical direction onto the elongate second members of the pair of drawer slides.

10. A mobile storage system comprising, in combination:

a cabinet including a rear wall, opposed left and right side walls connected to the rear wall, a top wall connected to the rear wall, and a bottom wall connected to the rear wall;

wherein the rear wall, the left and right side walls, the top wall, and the bottom wall cooperate to form an interior space having a front opening opposite the rear wall;

at least one pair of drawer slides secured to the left and right side walls respectively;

wherein the drawer slides each include an elongate first member that is rigidly secured to the associated side wall in the forward/rearward direction to prevent relative movement between the first member and the associated side wall and an elongate second member that is supported by the elongate first member and longitudinally movable relative to the first member in the forward/rearward direction so that the elongate second member can be selectively extended and retracted relative to the elongate first member in the forward/rearward direction;

at least one drawer removably connected to and supported by the elongate second members of the drawer slides so that the drawer is selectively movable into and out of the interior space through the front opening with the elongate second members of the drawer slides;

wherein the at least one drawer is selectively secured and removed from the elongate second members of the drawer slides by lowering and lifting the at least one drawer in the vertical direction relative to the elongate second members of the drawer slides; and wherein the at least one drawer is configured as a suitcase.

11. The mobile storage system according to claim 10, wherein opposed lateral sides of the at least one drawer are each provided with at least one bracket configured to receive an upwardly-extending tab of the elongate second members of the pair of drawer slides when the at least one drawer is lowered onto the elongate second members of the pair of drawer slides in the vertical direction to removably secure the at least one drawer to the elongate second members of the pair of drawer slides.

12. The mobile storage system according to claim 11, wherein the opposed lateral sides of the at least one drawer are each provided with a spaced-apart pair of the brackets configured to receive a space-apart pair of the upwardly-extending tabs on each of the elongate second members of the pair of drawer slides to removably secure the drawer to the elongate second members of the pair of drawer slides.

13. The mobile storage system according to claim 10, wherein the suitcase is an expandable suitcase.

14. The mobile storage system according to claim 10, wherein there are a plurality of the pairs of drawer slides secured to the left and right side walls respectively, there are a plurality of the drawers removably connected to and supported by the plurality of the drawer slides so that the plurality of drawers are each movable into and out of the interior space through the front opening, and each of the plurality of drawers is configured as a suitcase.

15. The mobile storage system according to claim 10, wherein the cabinet is configured to be converted between an open configuration for use and a folded configuration for transportation;

wherein, in the open configuration, the left and right side walls are parallel and each perpendicularly extend from the rear wall in a forward direction, the top wall perpendicularly extends from the rear wall in the forward direction and horizontally extends between the left and right side walls, the bottom wall perpendicularly extends from the rear wall in the forward direction and horizontally extends between the left and right side walls, and the top wall is parallel with and spaced-apart from the bottom wall; and wherein, in the folded configuration, the left and right side walls are each parallel with and in front of the rear wall, the top wall, the top wall is parallel with and in front of the rear wall, the bottom wall is parallel with and in front of the rear wall.

16. The mobile storage system according to claim 15, wherein, in the folded configuration, the top wall and the bottom wall are each located between rear walls and the left and right side walls.

17. The mobile storage system according to claim 15, wherein the cabinet further includes a pair of laterally spaced-apart wheels located at the bottom of the rear wall.

18. The mobile storage system according to claim 17, wherein the cabinet is configured so that the cabinet can be supported and transported on the wheels in both the open configuration and the folded configuration.

19. The mobile storage system according to claim 10, wherein further comprising attachments configured to removably secure the at least one drawer to the elongate second members of the drawer slides when the at least drawer is lowered in the vertical direction onto the elongate second members of the pair of drawer slides, and wherein the attachments each include a vertically extending tab insertable into a cooperating bracket when the at least drawer is lowered in the vertical direction onto the elongate second members of the pair of drawer slides.

20. A mobile storage system comprising, in combination:

a cabinet including a rear wall, opposed left and right side walls connected to the rear wall, a top wall connected to the rear wall, and a bottom wall connected to the rear wall;

wherein the cabinet is configured to be converted between an open configuration for use and a folded configuration for transportation;

wherein, in the open configuration, the left and right side walls are parallel and each perpendicularly extend from the rear wall in a forward direction, the top wall perpendicularly extends from the rear wall in the forward direction and horizontally extends between the left and right side walls, the bottom wall perpendicularly extends from the rear wall in the forward direction and horizontally extends between the left and right side walls, and the top wall is parallel with and spaced-apart from the bottom wall so that the rear wall, the left and right side walls, the top wall, and the bottom wall cooperate to form an interior space having a front opening opposite the rear wall;

wherein, in the folded configuration, the left and right side walls are each parallel with and in front of the rear wall, the top wall is parallel with and in front of the rear wall, and the bottom wall is parallel with and in front of the rear wall;

wherein the cabinet further includes a pair of laterally spaced-apart wheels located at the bottom of the rear wall;

wherein the cabinet further includes at least one pair of drawer slides secured to the left and right side walls respectively;

wherein the drawer slides each include an elongate first member that is rigidly secured to the associated side wall in the forward/rearward direction to prevent relative movement between the first member and the associated side wall and an elongate second member that is supported by the elongate first member and longitudinally movable relative to the first member in the forward/rearward direction so that the elongate second member can be selectively extended and retracted relative to the elongate first member in the forward/rearward direction;

at least one drawer removably connected to and supported by the elongate second members of the at least one pair of drawer slides so that the at least one drawer is selectively movable into and out of the interior space through the front opening with the elongate second members of the drawer slides;

wherein the at least one drawer is selectively secured and removed from the elongate second members of the drawer slides by lowering and lifting the at least one drawer in the vertical direction relative to the elongate second members of the drawer slides;

wherein opposed lateral sides of the at least one drawer are each provided with at least one bracket configured to receive an upwardly-extending tab of the elongate second members of the pair of drawer slides when the at least one drawer is lowered onto the elongate second members of the air of drawer slides in the vertical direction to removably secure the at least one drawer to the elongate second members of the air of drawer slides; and wherein the at least one drawer is configured as a suitcase.

* * * * *